United States Patent [19]

Hasbrouck, deceased

[11] Patent Number: 4,516,619

[45] Date of Patent: May 14, 1985

[54] PARTITION SYSTEM AND CONNECTORS THEREFOR

[75] Inventor: Gene B. Hasbrouck, deceased, Late of Corry, Pa., by Anna B. Hasbrouck, legal representative

[73] Assignee: Hon Industries, Inc., Muscatine, Iowa

[21] Appl. No.: 408,447

[22] Filed: Aug. 16, 1982

[51] Int. Cl.[3] ..... A47G 5/00

[52] U.S. Cl. ..... 160/135; 160/229 R; 52/239

[58] Field of Search ..... 160/135, 357, 229; 52/126.4, 243.1, 270, 285; 403/217, 219, 231

[56] References Cited

U.S. PATENT DOCUMENTS

| | | | |
|---|---|---|---|
| 2,019,977 | 11/1935 | Miult et al. | 52/126.4 |
| 3,037,588 | 6/1962 | Causey | 403/217 |
| 3,168,772 | 2/1965 | Williams | 52/285 |
| 3,920,345 | 11/1975 | Stoltz | 403/217 |
| 3,999,353 | 12/1976 | Dielman | 52/126.4 |
| 4,185,430 | 1/1980 | Gartung | 52/285 |
| 4,416,093 | 11/1983 | Salkeld et al. | 160/135 |

*Primary Examiner*—Peter M. Caun

*Attorney, Agent, or Firm*—Neuman, Williams, Anderson & Olson

[57] ABSTRACT

In partitions with round edged panels arranged in edge-to-edge abutting relation with one another and having glides near their respective lower edges, snap-on bottom connectors span the inter-panel joints by being snapped onto the glide stems. The connectors are flat plates with open sided latch portions for engaging the stems and having detents spaced from one another a distance slightly less than the distance between the remote edges of the engaged stems when the panels are in abutting relation with one another. The compressibility of the panel edges and/or the resilience of the system permit a snap interference fit of the connectors on the stems to hold the panels firmly in compressive edge-to-edge engagement with one another. Lock nuts secure the connectors in place. The connectors may be installed and removed readily with the panels in their normal upright partition forming positions, for convenient removal and substitution of panels after the system has been assembled.

9 Claims, 11 Drawing Figures

FIG. 1
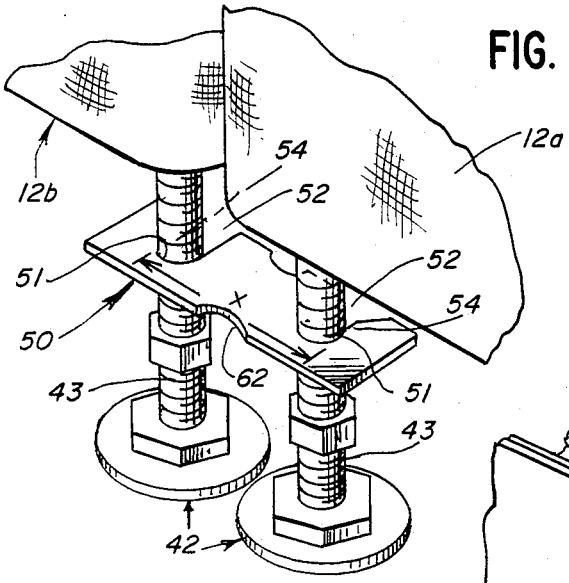
FIG. 2
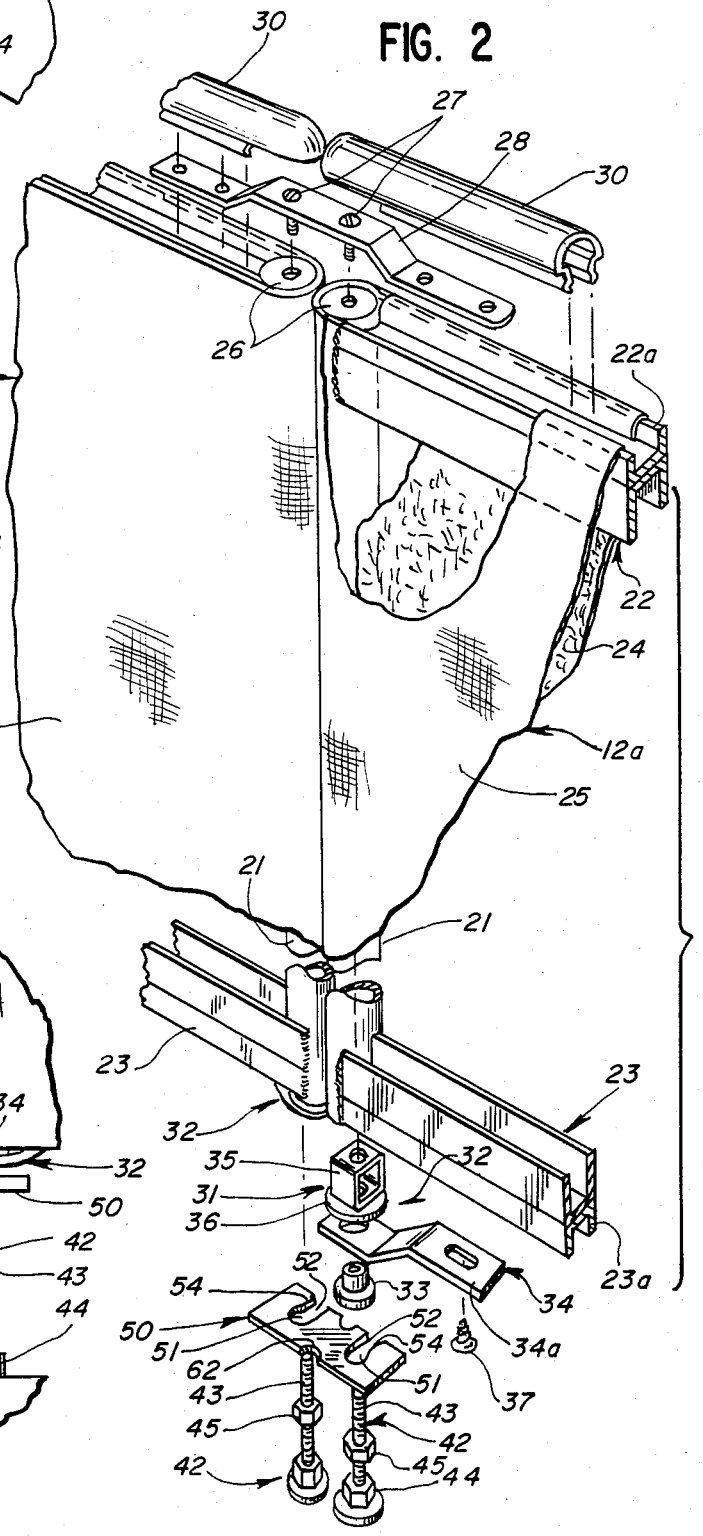
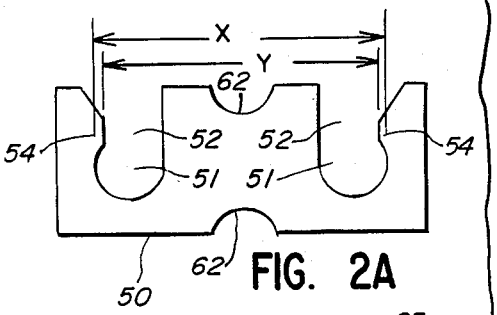
FIG. 2A
FIG. 3
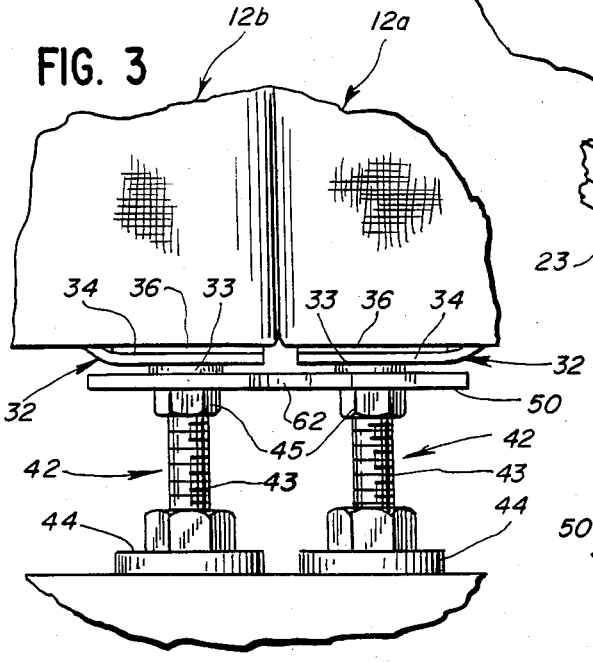

FIG. 4
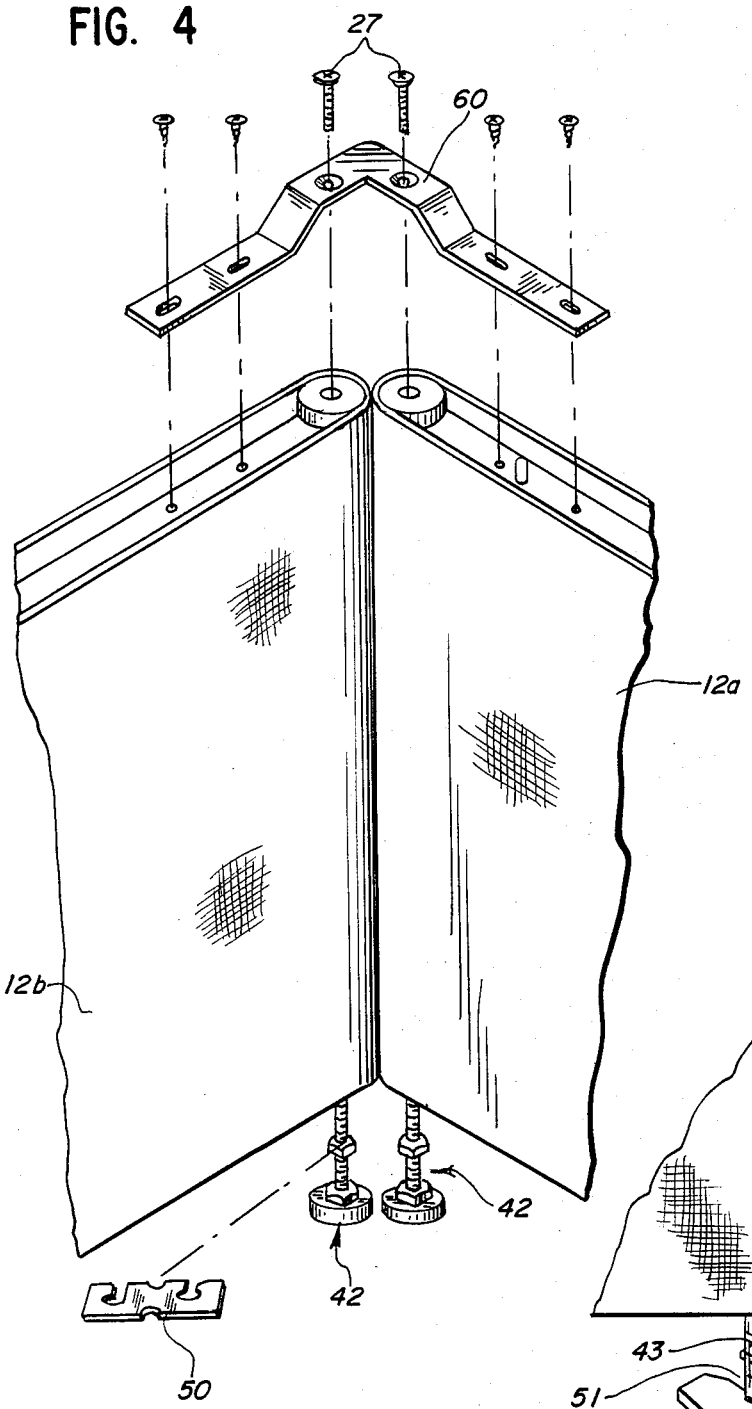
FIG. 5
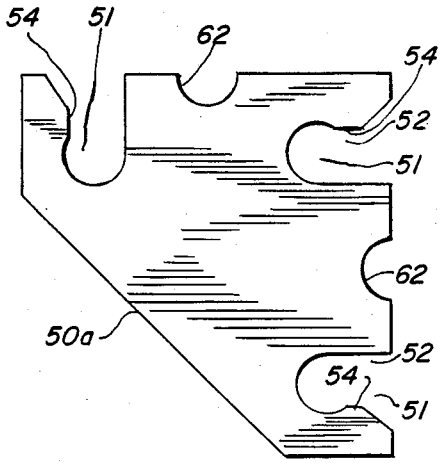
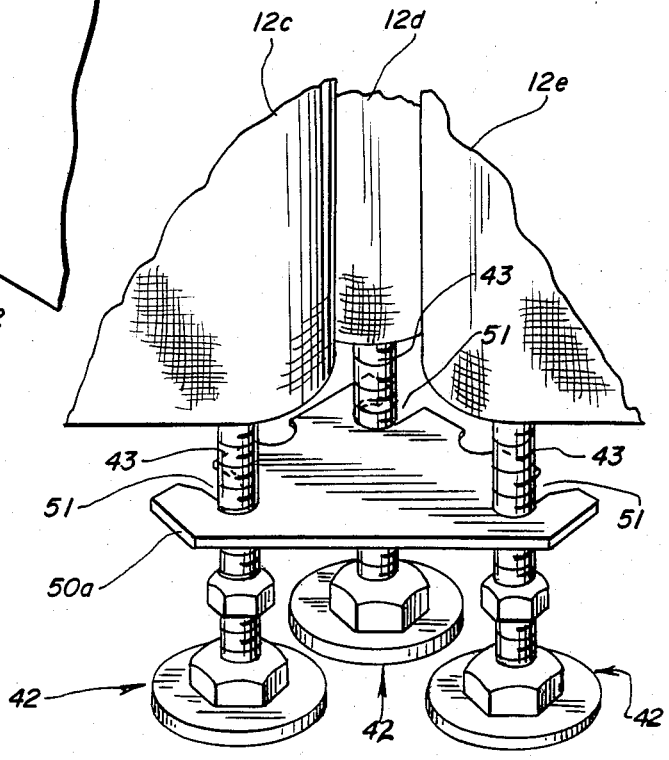
FIG. 6

PARTITION SYSTEM AND CONNECTORS THEREFOR

BACKGROUND OF THE INVENTION

This invention relates to movable partition systems and the manner of connecting adjacent panels particularly the lower portions of panels, in such systems.

A wide variety of partition systems have been proposed in which multiple prefabricated panels and related components are assembled in various configurations to define work stations, corridors, etc. within large otherwise open office spaces. These are sometimes referred to as office landscape systems. The panels typically are movable in that they are not permanently attached to the building structure. Normally they are joined to one another side-by-side in various layout configurations or patterns to define the work stations or bays with some of the panels at angles to others both to define the side limits of individual bays or stations and to provide stability for the entire system. For example, a single modular panel may form the back wall of a work bay or station. Similarly, two or more panels in aligned coplanar array may form the rear wall of a larger bay or station.

Use of panels of a uniform standard width is desirable for economy and flexibility. Moreover, the system must be adaptable to a variety of layout arrangements to provide flexibility of space utilization. This requires junctions or "joints" of a variety of configurations, including two-panel joints with the panels in mutual alignment or at various angles to one another, three-panel joints and four-panel corner joints. Moreover, the geometry of using standard panels to provide systems with modular work spaces requires that adjacent panels sometimes be spaced apart slightly, particularly as between two of the adjacent panels at some joints.

A variety of connector devices and arrangements have been provided for use in the assembly of such systems. Such connectors have provided secure connections, for example, in the "2000" system of Corry-Jamestown Corporation, Corry, Penna., which has used brackets spanning the joints at the top and the bottom of the panels. However, these brackets were attached to the lower edges of the respective panel frame with the glide stems through the brackets, which has made installation, removal and replacement of individual panels somewhat awkward, time consuming and disruptive. Since flexibility and movability is highly desirable in these systems, the connections should allow quick assembly and disassembly of individual panels within the system without tipping or disassembling adjacent panels and should provide ready accessibility and ease of use of connections made close to the floor, adjacent the bottoms of the panels.

OBJECTS OF THE INVENTION

It is an object of this invention to provide improved panel connections in partition systems, and particulary to provide connections which will satisfy the aforenoted requirements and overcome the aforenoted problems.

It is another object of this invention to provide a spacing and connecting device that allows quick assembly and disassembly of partition systems.

It is a further object of this invention to provide spacing and connecting systems which allow the bottom joint connections of partition systems to be made close to the floor after the structure members are placed in their final position and allow removal and replacement of individual panels without tipping, raising or removing adjacent panels.

Further and additional objects will appear from the description, accompanying drawing, and appended claims.

SUMMARY OF THE INVENTION

In accordance with one embodiment, partition panels arranged in edge-to-edge abutting relation with one another each have a protruding pin, comprising the lower glide stem, near the respective edge. A snap-on bottom connector spans this inter-panel joint and snaps onto the glide stems. The connector is a flat plate with open sided latch portions for engaging the stems. Each latch portion has a detent shoulder at its outer edge. In the preferred embodiment these detents are spaced from one another a distance slightly less than the distance between the remote edges of the engaged stems when the panels are in such abutting relation with one another. The compressibility of the panel edges and/or the resilience of the system permit a snap interference fit of the connector on the stems, to hold the panels firmly in compressive edge-to-edge engagement with one another. Lock nuts may be provided on the stems for securing the connectors in place. The connectors may be installed and removed readily with the panels in their normal upright partition forming positions. This allows removal and substitution of panels after the system has been assembled in order to add or remove or repair panels or modules without moving any other unaffected sections of the system.

DESCRIPTION OF SPECIFIC EMBODIMENTS

For a more complete understanding of this invention, reference should now be made to the embodiments illustrated in greater detail in the accompanying drawings and described below by way of examples of the invention. In the drawings:

FIG. 1 is a partial perspective view of abutting portions of two partition panels being joined in a connection embodying teachings of this invention;

FIG. 2 is an enlarged, partial, exploded view of adjacent portions of the panels of the assembly of FIG. 1;

FIG. 2A is a plan view of the connector included in the assembly of FIG. 1;

FIG. 3 is a front view of the completed assembly of FIG. 1;

FIG. 4 is a partial exploded view of a similar connection being effected between a pair of panels at right angles to one another;

FIGS. 5 and 7 are plan views of two connectors for joining three panels and employing teachings of this invention;

FIG. 6 is a partial perspective view similar to FIG. 1 illustrating a panel connection with the connector of FIG. 5;

Figure 7:
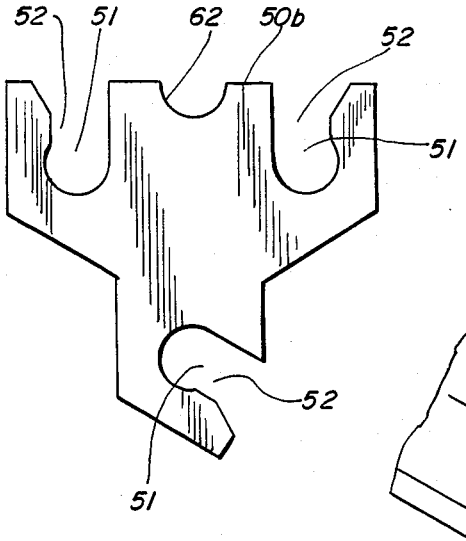

It should be understood that the drawings are not necessarily to scale and that an embodiment is sometimes illustrated in part by phantom lines and fragmentary views. In certain instances, details of the actual structure which are not necessary for the understanding of the present invention may have been omitted. It should be understood, of course, that the invention is not necessarily limited to the particular embodiments illustrated herein.

Turning first to FIGS. 1–3 there is illustrated an assembly 10 of portable partition panels 12*a* and 12*b* of the type included in the aforementioned "2000" panel system presently being marketed commercially by Corry Jamestown Corporation of Corry, Penna., which is a division of HON INDUSTRIES, Inc., of Muscatine, Ia. The specific panels and their general manner of assembly to one another in a partition system layout, and the details of the upper connector arrangement, are presented to illustrate a preferred embodiment of the invention and its manner of practice. They do not themselves constitute a part of this invention.

It will be appreciated that partition panels such as panels 12 may be assembled in a wide variety of floor plan layout configurations, and may define work stations of various configurations and widths, e.g., a width equal to the effective assembled width of a single modular panel 12*a* or 12*b* between laterally-extending end panels or a width equivalent to two or more of the modular panels.

The present invention is particularly directed to the connector arrangement at the lower ends of the panels.

Referring particularly to FIG. 2, each of the panels 12 includes a frame comprising a vertical hollow round tubular post 21 at each side edge, and transverse end channel members 22 and 23 joined to these posts as by welding. Additional horizontal members (not shown) typically extend between the side posts 21 intermediate the end members 22 and 23, e.g. of structure similar to members 22 and 23, such as for the attachment of work surfaces or other hanging components. Appropriate core materials 24, such as of glass fiber, are included for sound attenuation purposes. A sleeve of fabric 25 covers each complete panel for appearance purposes. As seen in FIG. 2, the channels 22 and 23 are pairs of channels disposed back-to-back to form a composite H section. The top channel 22*a* is open upwardly, and the bottom channel 23*a* is open downwardly. The end edges of the fabric 25 are turned into the top and bottom channels 22*a* and 23*a* and into the respective adjacent ends of the respective tube 21 and are suitably attached thereto, such as by adhesion.

An element 26 is inserted in the upper end of each tube and receives a fastener 27 for attaching a bracket 28 to join the adjacent panels in abutting coplanar alignment with one another as in the instance of the panels 12*a* and 12*b*. As will be pointed out below, various other brackets of appropriate designs are utilized for joining the panels 12 in other configurations, such as for angular connections or for T connections between two aligned panels and a lateral panel. In addition, top trim elements 30 of appropriate decorative configuration are attached to the tops of the panels, as by friction clip engagement, after the assembly is completed, for appearance purposes.

The construction at the lower end of each panel includes a bottom connector bracket assembly 32 for the lower end of each tube 21, only one such assembly being illustrated in exploded array in FIG. 2. Each assembly 32 includes a plug 31, similar to element 26, an internally threaded nut 33 and a spacer bracket 34. The plug 31 includes a body 35 for fitting engagement in the end of the respective tube 21 and an end cover washer 36 which are attached to one another and to the subjacent portion of bracket 34 as by welding. The nut 33 fits into suitable aligned openings through the bracket 34, washer 36 and outer end of the body 35 and is attached to the assembly 32, also as by welding. The inner end of the plug 31 also is formed with an aligned opening to accommodate passage therethrough of the stem of a glide as noted further below. The bracket assembly 32 is assembled with a panel by inserting the body 31 in the lower end of the respective tube 21 while locating the inwardly offset distal end portion 34*a* of bracket 34 in the channel 23*a*, and securing the assembly thereto, as by applying a metal screw 37 through bracket portion 34*a* and into the bight portion of channel 23*a*.

A support glide 42 is applied to each panel at the lower end of each side tube 21. Each glide includes a threaded stem 43, a foot or base 44 at one end, and a locking nut 45 threadably carried on the stem. The stem is threaded into the respective nut 33, extending into and through plug 31 as necessary, and is adjusted therein by turning for adjusting the height of and leveling the panel in the usual manner.

A base (not shown) also may be attached to the lower edge of each panel between the side tubes and glides to close the space between the bottom edge of member 23 and the subjacent support surface for decorative purposes and to accomodate service wires.

A connector 50 is provided for joining two such panels in abutting relation with one another. The connector 50 consists of a flat plate made of metal or any other suitable material and having a lateral opening 51 adjacent each end, as illustrated. These openings include throat portions 52, each having a detent shoulder 54 at its outer side. The openings 51 including throats 52 are of sizes to readily pass the stems 43. The outer edges of openings 51 are spaced apart a distance corresponding to the spacing between the remote or distal surfaces of two adjacent stems of abutting panels when those panels are in snug abutting engagement with one another to provide a uniform abutment joint. (This distance or dimension is indicated as "x" in FIGS. 1, 2A and 8.) The shoulders 54 are spaced a distance ("y" in FIG. 2A) which is slightly less than the aforenoted distance to provide an interference snap engagement of the connector 50 onto such stems and thereby to hold the panels firmly together and to retain the connector 50 in place. By way of example, in a partition system as illustrated with openings 51, 52 of 0.437" O.D. at nominal centerline to centerline spacing of 1.517", to accomodate stems 43 of $\frac{3}{8}$" O.D. at nominally 1.578" centerline spacings when the panels are abutted, a shoulder height of 1/32" (0.031", with shoulder to shoulder spacing (y) of 1.892" and edge to edge spacing (x) of 1.954") has been found satisfactory to secure firm snap engagement and retention of the components. These dimensions provide throats 52 of 13/32" width to admit 3/8" stems 43. It appears that some combination of the compressibility of the fabric 25, flexibility of the bracket 34, and/or flexibility of the cantilever stems 43 probably affords the requisite resilient yielding movement for this interference snap engagement.

By way of further illustration, in assembling panels using the connector 50, one end of the connector may be engaged laterally at one opening 51 upon the stem 43 of a glide at one edge of a panel and the respective nut moved upward to hold the connector in place but permitting pivotal movement of the connector. After the next panel is set into place abutting the previous panel, and the top connection is completed such as with bracket 28, the connector 50 can be swung into engagement position and forced laterally at the other opening 51 onto the stem of a glide of the newly added panel. Then both of the respective nuts 45 are tightened to lock the connector in place.

If it becomes necessary to remove a panel for any reason, the connectors 50 are readily accessible for disengagement. The nuts 45 locking the connectors 50 holding the bottom edges of that panel may be loosened and the connectors disengaged laterally, with no raising or tipping of the adjacent panels required to effect that disengagement. Thereupon, following disengagement of the appropriate top connectors, the selected panel may be removed. The same panel or another panel may be inserted in the assembly in the reverse manner, without disturbing the adjacent partition components.

Since the edges of the panels are round in section and the stems 43 are at the center of curvature (the centerlines of tubes 21), the same connectors 50 may be used for joining two panels 12*a* and 12*b* at any angle. The 90° assembly of FIG. 4 illustrates this feature. In that assembly a top bracket 60 of a configuration appropriate to the desired angular relation of the panels is used, e.g., with the legs at right angles to one another. The connector 50 is applied and is removable in such angular joint assemblies in the same manner as described above with respect to FIGS. 1–3.

The notches 62 illustrated in the mid-portions of the connector 50 accommodate positioning of the aforementioned decorative and sevice bases.

Since the connector 50 pivots into and out of its engagement with a panel being added or removed, the connector may be permanently attached at one end to one of the panels and thus have an open latch opening only at the free or distal end. However, the illustrated version of independent connectors with both ends open provides greater flexibility and adaptability of installation and greater freedom of use of standard panels at joints of various configurations, and is preferred.

The connector 50*a* shown in FIGS. 5 and 6 is designed for use in securing three panels 12*a*, 12*d* and 12*e* corresponding to panels 12*a* and 12*b* together in a joint assembly, with two abutment joints between two pairs of the panels 12*c*–12*d* and 12*d*–12*e*, and a controlled gap at the joint between the other pair 12*c*–12*e*, as seen in FIG. 6. Such a gap insures maintenance of modular spacing between lateral panels, such as between panel 12*d* and other lateral panels (not shown) at the outward ends of panels 12*c* and 12*e*, in a known manner. A top connector (not shown) of appropriate integral three-leg shape corresponding to the angular array of the panels and adapted to the described panel positions is used at a joint such as in FIG. 6. Each of the latch openings 51 of the connector 50*a* is oriented normal or at an oblique angle to each line joining the center of the respective opening and the center of each adjacent opening. As in the connector 50, each line of abutment between panels occurs on the line joining the center of the respective two openings 51 and in a plane generally normal to that line. The panels and connectors are assembled in the same manner as described above for a two-panel joint, except that the connector 50*a* is not pivoted when attaching the third panel. The third panel is slid into position to engage its respective stem 43 in the respective opening 51. Since each of the three openings 51 opens in parallel or outwardly diverging relation to each other opening, i.e. the axes of the throats 52 are parallel or outwardly diverging and hence "outwardly non-converging", the direction of movement of any panel during such insertion or removal is parallel to or divergent from the planes of abutment of that panel with each other panel. Thus, any panel forming the joint can be inserted, removed and replaced by such sliding movement without disassembly, lifting or tipping of the other panels of the joint assembly.

Figure 8:
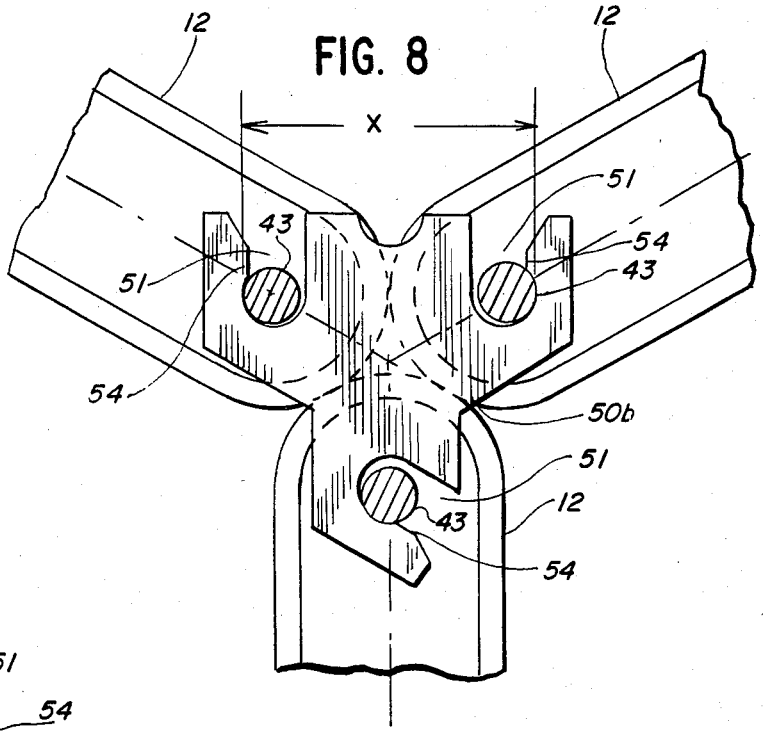
FIG. 8 is a partial bottom sectional view, taken through the glide stems and looking up, of a three-panel connection with the connector of FIG. 7 and with the panels shown schematically.

The connector 50*b* shown in FIGS. 7 and 8 is designed for use in securing three panels 12 also corresponding to panels 12*a* and 12*b* together in a joint assembly with all three panels in mutually abutting relation, for example as seen in FIG. 8. The three panels may extend at any angle to one another. Typical relationships are with the center planes of the three panels along radii spaced 120° apart, as illustrated in FIG. 8, or with two of the panels defining a 90° angle and the included angle between each of those panels and the third panel being 135°.

Figure 9:
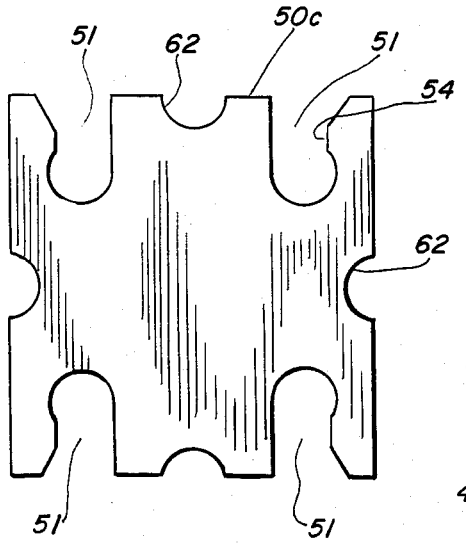
FIG. 9 is a plan view of a connector for joining four panels and employing teachings of this invention; and, FIG. 10 is a view similar to FIG. 8 illustrating a four-panel joint with the connector of FIG. 9.
Figure 10:
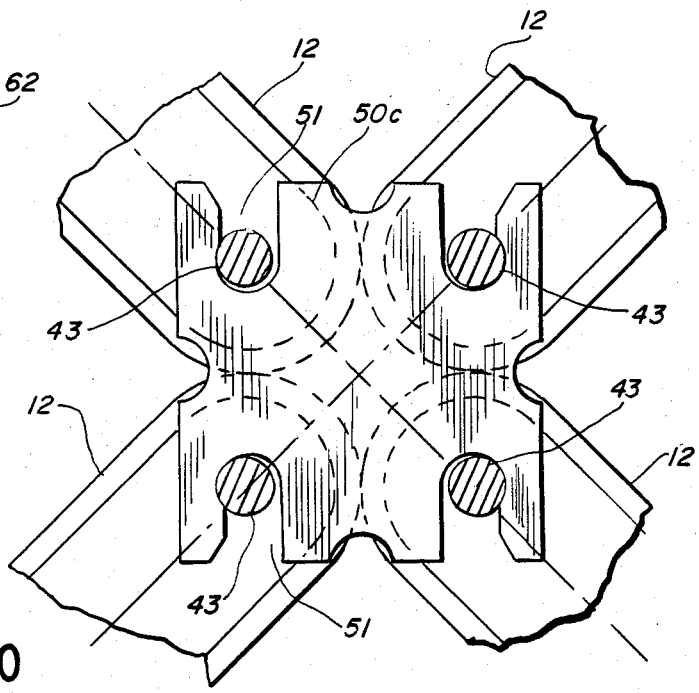

The connector 50*c* shown in FIGS. 9 and 10 is designed for use in a joint assembly of four panels 12 corresponding to panels 12*a* and 12*b* arranged in a right angular array, as illustrated in FIG. 10, with each adjacent pair of the panels in abutment with one another.

In each of the assemblies of FIGS. 8 and 10, a top connector (not shown) of appropriate integral multi-leg shape corresponding to the angular array of the panels and adapted to the described panel positions is used at the top end of the joint. The panels and connectors are assembled in the same manner as described above for the three-panel joint of FIG. 6. Again, since each of the openings 51 opens in parallel or outwardly diverging relation to each other such opening, i.e. the axes of the throats 52 are parallel or outwardly diverging and hence "outwardly non-converging", the direction of movement of any panel during such insertion or removal is parallel to or divergent from the planes of abutment of that panel with each other panel. Thus, any panel forming the joint can be inserted, removed and replaced by sliding movement, without disassembly, lifting or tipping of the other panels of the joint assembly.

The spacings between adjacent latch openings 51 in the various connectors 50*a*, 50*b* and 50*c* described above, except across the diagonal in connector 50*a*, are such as to insure firm retentive engagement of the connector on the stems 43 and abutment of the adjacent pairs of panels, substantially as described with respect to connector 50, to eliminate light gaps, provide uniform joint lines and/or eliminate sound transmission gaps between each pair of abutting panels.

It will be appreciated that the connectors may be of a variety of specific shapes and dimensions, and that the panels may be oriented at various angles. The detent shoulders represented by shoulders 54 and the locking action of the nuts 45 will hold the panels in abutment even when the throats are normal to the inter-panel abutment planes, as in FIG. 10.

Thus, a partition system and connectors have been provided which meet the aforestated objects of this invention.

While particular embodiments of the invention have been shown, it will be understood, of course, that the invention is not limited thereto since modifications may be made and other embodiments of the principles of this invention will occur to those skilled in the art to which this invention pertains, particularly upon considering the foregoing teachings. It is, therefore, contemplated by the appended claims to cover any such modification and other embodiments as incorporate those features which constitute the essential features of this invention within the true spirit and scope of the following claims.

What is claimed is:

1. A partition system comprising first and second partition panel components arranged in edge-to-edge abutting relation with one another, a glide stem disposed at the bottom of each panel component adjacent the respecttive abutment edge, a connector for spanning the joint between said first and second panel components and detachably retaining said first and second panels in abutting relationship with one another, said connector having spaced open-sided latch portions for engaging said glide stem on each of said panel components whereby said panel components are urged by said connector into such abutting relation.

2. A partition system comprising first and second partition panel components arranged in edge-to-edge abutting relation with one another, a glide stem disposed at the bottom of each panel component adjacent the respective abutment edge, a connector for spanning the joint between said first and second panel components and detachably retaining said first and second panels in abutting relationship with one another, said connector having spaced open-sided latch portions for engaging said glide stem on each of said panel components whereby said panel components are urged by said connector into such abutting relation; said panel components permitting resilient movement of said glide stems toward one another; the opposed remote edges of said connector latch portions including detent protrusions spaced from one another a distance slightly less than the distance between the remote edges of said glide stems when said latch portion remote edges are in non-compressive contact with said stem remote edges.

3. A partition system comprising first and second panel components arranged in edge-to-edge abutting relation to one another, a glide stem disposed at the bottom edge of each panel component adjacent the respective abutment edge, a connector for spanning the joint between said first and second panel components and detachably retaining said panel components in abutting relation with one another; said connector having first means pivotally engaging said connector with one of the glide stems of said panel components; said connector having a distal portion defining an open-sided latch portion having a detent portion for engaging the glide stem of the second of said panel components in a snap-on interference fit whereby said connector secures said panel components together in such abutting relationship.

4. A partition assembly as in claim 3 in which said panel components permit resilient movement of said stems toward one another and the opposed remote edges of said latch portions include detent protrusions spaced from one another a distance slightly less than the distance between the remote edges of said stems when said edges are in non-compressive contact with one another.

5. A partition assembly as in claim 1, 2 or 3 in which said glide stems are resiliently movable toward one another and the effective length of said connector is slightly less than the effective spacing between said first glide stems and said second glide stems.

6. A partition assembly as in claim 1, 2 or 3 in which the abutment edges of said panel components are resiliently compressible and the effective length of said connector is slightly less than the effective spacing between said first glide stems and said second glide stems.

7. A partition assembly as in claim 1, 2 or 3 in which said panel components are of arcuate section at said abutting edges.

8. A partition assembly as in claim 1, 2 or 3 including at least three panels in abutting relation at said joint and each including a glide stem adjacent said joint, said connector being formed with spaced open-sided latch portions for engaging each of said stems.

9. A partition assembly as in claim 1, 2 or 3 including further connector means spanning said joint and securing said panel components together at their upper ends, said glide stems and said connector being disposed adjacent the lower edges of said panel components.

* * * * *

UNITED STATES PATENT AND TRADEMARK OFFICE

CERTIFICATE OF CORRECTION

PATENT NO. : 4,516,619

DATED : May 14, 1985

INVENTOR(S) : Gene B. Hasbrouck (Deceased)

It is certified that error appears in the above-identified patent and that said Letters Patent is hereby corrected as shown below:

Column 8, lines 4 and 5 (Claim 3) should read "first means pivotally engaging said connector with the glide stem of one of said panel components; said con-"; Column 8, line 20 (Claim 5) delete ", 2"; Column 8, lines 24 and 25 (Claim 5) delete "first glide stems and said second"; Column 8, line 30 (Claim 6) delete "first glide stems and said second".

Signed and Sealed this

*First* Day of *October 1985*

[SEAL]

*Attest:*

DONALD J. QUIGG

*Attesting Officer*

*Commissioner of Patents and Trademarks—Designate*